United States Patent [19]

Veenstra

[11] Patent Number: 4,582,284

[45] Date of Patent: Apr. 15, 1986

[54] HANGER BRACKET FOR SECURING TO CHAIN LINK FENCES

[76] Inventor: Dan Veenstra, 1393 Forest Ave., Palo Alto, Calif. 94301

[21] Appl. No.: 495,715

[22] Filed: May 18, 1983

[51] Int. Cl.[4] ..... F16B 1/00

[52] U.S. Cl. ..... 248/220.2; 24/682; 256/32; 403/353

[58] Field of Search ..... 248/220.2, 221.2, 222.2, 248/224.3; 24/682, 683; 256/34, 32; 403/353

[56] References Cited

U.S. PATENT DOCUMENTS

| | | | |
|---|---|---|---|
| 1,575,409 | 3/1926 | Blaeser | 256/32 X |
| 1,669,782 | 5/1928 | Risser . | |
| 4,027,453 | 6/1977 | Bridge | 403/353 |
| 4,049,126 | 9/1977 | Halverson | 211/104 |
| 4,340,144 | 7/1982 | Cousins | 248/222.2 |

FOREIGN PATENT DOCUMENTS

| | | |
|---|---|---|
| 2640423 | 3/1977 | Fed. Rep. of Germany . |
| 710030 | 6/1954 | United Kingdom . |
| 800654 | 8/1958 | United Kingdom . |

*Primary Examiner*—J. Franklin Foss
*Assistant Examiner*—David L. Talbott
*Attorney, Agent, or Firm*—Thomas M. Freiburger

[57] ABSTRACT

A hanging device for hanging objects on a chain link fence includes a cruciform base member and a hook member extending from the base member.

4 Claims, 3 Drawing Figures

HANGER BRACKET FOR SECURING TO CHAIN LINK FENCES

BACKGROUND OF THE INVENTION

The invention relates to hanging devices, and more particularly to a hanging bracket for securing to a chain link fence, for hanging a garment or other article.

At tennis courts, baseball diamonds and other locations where chain link fences are common, it is often desired to hang articles of clothing such as jackets, warmup sweaters, etc. on the fence rather than laying them on the ground. Garments are often pushed through the diamond openings of the fence, but this can cause snagging damage if the fence wire is rough, as from burrs of galvanizing material.

Presently available devices for hanging garments, tennis rackets and other articles from a chain link fence are not always completely satisfactory for a number of reasons. First, some of the presently available devices are not adaptable for mounting in or hanging from the diamond opening of a chain link fence but must be mounted to the vertical and horizontal post and strengthening members. Second, certain conventional devices are difficult and time-consuming to attach to and remove from a chain link fence and require various movable fittings for mounting thereto. Many of the prior art devices would not be economical for the purposes of the present invention.

The following patents have some pertinence to the present invention, although none shows a device similar to that of the invention: U.S. Pat. Nos. 1,669,782 (Risser) and 4,049,126 (Halverson); British Patents Nos. 710,030 and 800,654; and German Offenlegungsschrift No. 2,640,423. These prior patents show devices for attaching objects to fences, wire grids, pegboards and other screen-like structures, but none is configured similarly or functions similarly to the device of the present invention.

SUMMARY OF THE INVENTION

For the foregoing reasons, a principal object of the present invention is an improved mounting device which is portable, pocket-sized and easily mounted in and removed from the diamond opening of a chain link fence, for hanging objects on the chain link fence.

Another object of the invention is a mounting device which is capable of supporting a substantial amount of weight.

Another object of the invention is a mounting device which can be quickly attached to and removed from a chain link fence without the use of movable mounting fittings or tools of any kind.

Another object of the present invention is a mounting device that is relatively inexpensive to manufacture.

Still another object of the present invention is a mounting device which can be used repeatedly at other chain link fence locations.

These and other objects, advantages and features of the invention will be apparent from the following description of a preferred embodiment, considered along with the accompanying drawings.

DESCRIPTION OF A PREFERRED EMBODIMENT

Figure 1:
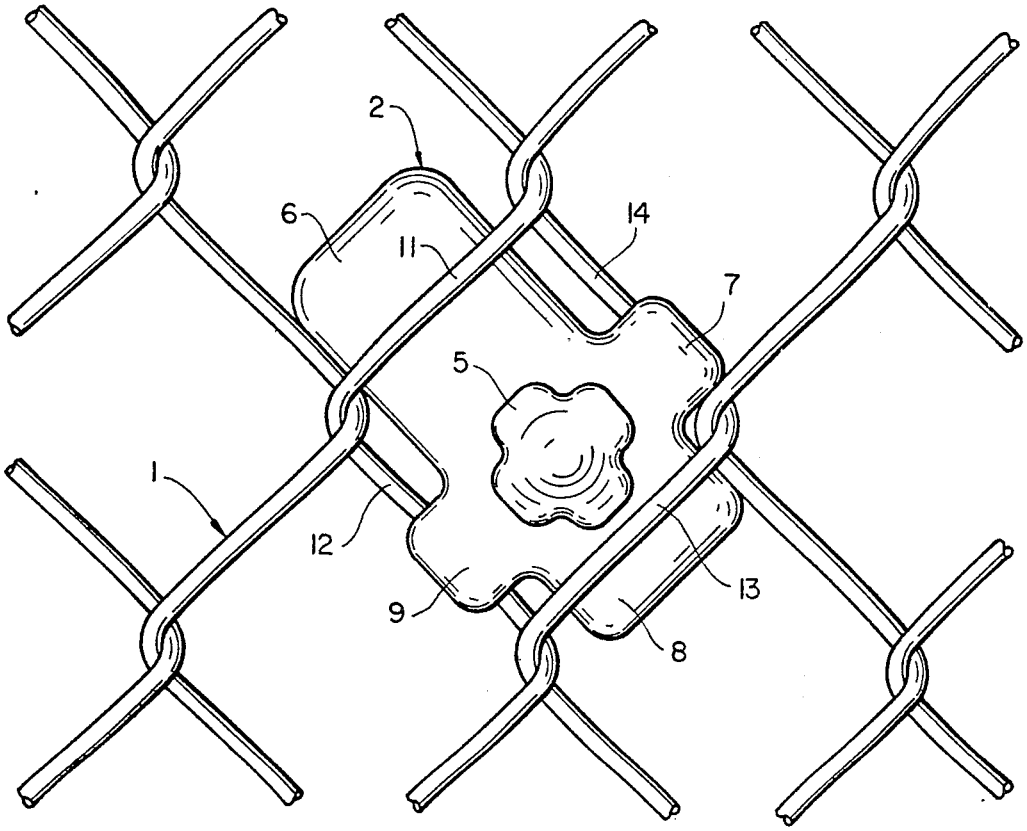
FIG. 1 is an elevation view showing a section of chain link fence with the hanger bracket of the present invention secured in a diamond opening of the fence.
Figure 2:
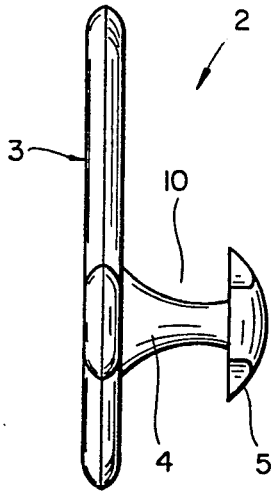
FIG. 2 is a side elevation view of the hanger bracket.
Figure 3:
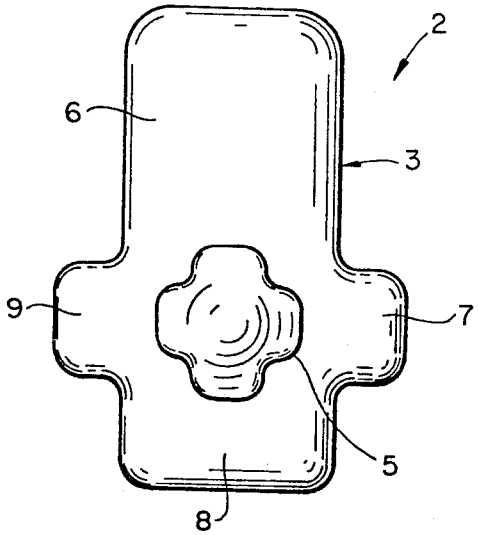
FIG. 3 is a front elevation view of the hanger bracket.

Referring now more particularly to the drawings, there is illustrated a chain link fence 1 which has a hanging bracket or mounting device 2 of the present invention mounted thereon.

In practice, the mounting device 2 is formed from molded plastic material, such as phenolic resin or the like, and as such, it is relatively inexpensive to manufacture.

Considering its construction, the mounting device 2 of the present invention incorporates a base 3, a hook 5, and a proximal portion 4 which extends rearwardly from the hook 5 to the base 3 for supporting the hook 5 thereon.

The base 3 is substantially flat and preferably has four extended arms 6, 7, 8 and 9 of varying lengths and widths as shown. The arms 6, 7, 8 and 9 are in a cruciform arrangement with the arms 7 and 9 extending in opposite directions perpendicular to the arms 6 and 8. The lengths of the arms 7, 8 and 9 are less than the length of the arm 6. The necessary length of each of the arms depends on the size of the diamond-shaped hole in the chain link fence in which the device is fitted. To assure retention therein, the arms are of a length sufficient to span the diamond-shaped hole and be captured by the opposing link members thereof. Optionally, the arm 6 may be made somewhat longer than necessary to effect capture by a fence link member. This may be done for providing a surface for a logo, the owner's name, etc. The width of the arms 6 and 8 may be such as to nearly fill the space between opposite link members whereas the width of the arms 7 and 9 is considerably less, so as to permit sliding the device in the hole to insert and remove it.

In use, the arms 6 and 8 of the base 3 extend behind an upper 11 and lower 13 outwardly protruding link of one of the diamond-shaped holes of the chain link fence 1. The remaining two arms 7 and 9 of the base 3 extend in front of the remaining upper 14 and lower 12 inwardly recessed links, which are opposite to one another, within the same diamond-shaped hole.

The hook member 5 which is connected to the proximal portion 4 and then to the base 3 forms a receiving slot 10 for receiving an object to be hung thereon, or for attachment of a dog leash or other article.

To attach the mounting device 2 of the present invention to the chain link fence 1, one holds the device with the base 3 generally in a vertical plane, parallel to the surface of the fence, with the longest arm 6 positioned to the upper left (or the upper right, depending on the fence). The upper left arm 6 is then tilted toward the fence at approximately a 40° angle and inserted through the diamond-shaped hole of the chain link fence 1 and behind the upper left link 11. The mounting device 2 is then brought to a position parallel to the fence 1, while maintaining the upper left arm 6 behind the said link 11. The two arms 7 and 9 then rest in front of the two links 14 and 12, respectively, adjacent to the link 11. The mounting device 2 is then moved obliquely downward and to the right, thus positioning the lower right arm 8 behind the lower right protruding link 13.

Once the present invention is attached to the chain link fence 1, a substantial amount of weight or obliquely angled pulling force may be exerted on it. When an object is hung from the receiving slot 10, the mounting device is firmly affixed in place within the diamond-shaped hole of the chain link fence 1, due to positioning of the back side of the lower left arm 9, the back side of the upper right arm 7, the front side of the upper left arm 6, the front side of the lower right arm 8, and their respective receiving links 12, 14, 11, 13 surrounding the diamond-shaped hole.

It will be evident from the above description that the present invention provides a hanger bracket specifically for use on chain link fences. It not only provides a means of hanging garments and attaching other objects from a fence but is also reusable, and pocket-sized. Sports enthusiasts that participate in tennis, badminton, etc., have often pushed their garments through diamond-shaped holes in the chain link fences, which often results in torn and snagged material. The present invention provides a means of hanging garments without damaging them. It can also be carried within the pocket of a tennis racket cover.

While the invention has been illustrated and described in detail in the drawings and foregoing description, the same is to be considered as illustrative and not restrictive in character, it being understood that only the preferred embodiment has been shown and described and that all changes and modifications within the spirit of the invention and the scope of the claims are also desired to be protected. For example, the device is described having a hook of a particular shape as an integral part of the base. It is also described as being used in individual units. In each of the above cases, changes may be made. The hook described may be removably mounted to the base so that hooks of different shapes may be employed. Also a plurality of devices may be ganged together for hanging large or very heavy objects. Accordingly, it is intended that the invention be limited only by reference to the claims and their equivalents.

I claim:

1. A hanger device for securing in a diamond-shaped opening of a chain link fence of woven wire mesh wherein each diamond-shaped opening is formed between a pair of parallel outwardly protruding links and a pair of parallel inwardly recessed links generally at right angles to the outwardly protruding links, for mounting an object thereon, comprising:

a base including four extended arms substantially in a single plane and generally in a cruciform arrangement, with one pair of opposed arms being wide, for extending almost the width of an opening in a chain link fence in which the device is to be used, and a second pair of opposed arms being substantially narrower, and one arm of said one pair being longer than the other three arms; and a hook member extending outwardly from the base for mounting an object thereon.

2. The hanger device of claim 1 wherein said second pair of arms each have a width that permits sliding the one longer of said one pair of arms up and under beneath one upper protruding link of a diamond-shaped opening of a chain link fence so that, with the second pair of arms resting against recessed links generally perpendicular to the upper protruding link, the device can be moved obliquely downwardly to a position with the arm opposite said one longer arm beneath a lower protruding link opposite said one upper protruding link, whereby the hanger device is locked in place with said one pair of opposed arms beneath protruding links and said secnd pair of opposed arms in front of and against recessed links.

3. A method for providing a mounting hook on a chain link fence, comprising:

in a diamond-shaped opening of the chain link fence, inserting a hanger device having a hook member extending from a generally cruciform-shaped base with four extending substantially coplanar arms, one longer than the other three and being one of a pair of opposed arms which are nearly as wide as the fence opening, the other two opposed arms being perpendicular to the one longer arm and of much less width, by sliding the longer arm obliquely upwardly behind a first protruding link of the diamond-shaped opening, pushing the hanger device generally flat into the fence so that said other two arms are positioned substantially against a pair of recessed links of the fence which are perpendicular to the first protruding link, and then sliding the hanger device obliquely downwardly, in generally the opposite direction from that in which the longer arm was inserted, so that the wide arm opposite the longer arm slides behind a second protruding link which is parallel to said first protruding link.

4. In combination with a chain link fence, of the kind formed of woven wire mesh and having a multiplicity of diamond-shaped openings, each formed by two opposed generally parallel inwardly recessed wire links and two opposed generally parallel outwardly protruding wire links, generally perpendicular to the recessed links, a hanger bracket for hanging or securing an article to the fence, comprising:

a base member generally in a single plane formed of four outwardly extending arms, generally equally angularly spaced, a first arm being longer than the other three, a second arm opposite and generally in a straight line with the first arm, and third and fourth side arms;

the first and second arms being of greater width than the side arms, their width being almost as wide as the distance between two of said recessed links in the fence, and the side arms being of considerably less width than the distance between two of said protruding links forming the diamond-shaped opening in the fence;

a hook member extending outwardly in a direction generally perpendicular to the base member, for supporting an article to be attached to the fence;

whereby the hanger bracket may be secured to the chain link fence by first inserting the longer first arm obliquely upwardly and under an upper protruding link of the diamond-shaped opening of the fence, until the second arm of the base member clears the opposite protruding link, at the lower side of the diamond-shaped opening, then the hanger bracket may be pushed flatly into the diamond-shaped opening, to a position generally coplanar with the fence, until the side arms are substantially in a position of contact with the two recessed links about the diamond-shaped opening, then the hanger bracket may be moved slidingly and angularly downwardly to slide the second arm under the lower protruding link until the edges of the side arms engage the links about the diamond-shaped opening to limit the movement of the hanger bracket, so that the hanger bracket is then confined among the four links about the diamond-shaped opening, with the first and second arms of the base member held under the two protruding links about the opening.

* * * * *